US009768513B2

(12) United States Patent
Lee et al.

(10) Patent No.: US 9,768,513 B2
(45) Date of Patent: Sep. 19, 2017

(54) WIRELESS ACCESS POINT

(71) Applicant: Google Inc., Mountain View, CA (US)

(72) Inventors: Yau-Shing Lee, Sunnyvale, CA (US); Jiang Zhu, Cupertino, CA (US); Ajay Chandra Venkata Gummalla, Sunnyvale, CA (US); Dieter W. Statezni, Cupertino, CA (US); Patanjali Sastry Peri, Fremont, CA (US)

(73) Assignee: Google Inc., Mountain View, CA (US)

( * ) Notice: Subject to any disclaimer, the term of this patent is extended or adjusted under 35 U.S.C. 154(b) by 82 days.

(21) Appl. No.: 14/707,769

(22) Filed: May 8, 2015

(65) Prior Publication Data

US 2016/0329641 A1 Nov. 10, 2016

(51) Int. Cl.

| | |
|---|---|
| ***H01Q 9/28*** | (2006.01) |
| ***H01Q 9/26*** | (2006.01) |
| ***H01Q 15/14*** | (2006.01) |
| ***H01Q 1/02*** | (2006.01) |
| ***H01Q 1/22*** | (2006.01) |
| ***H01Q 1/24*** | (2006.01) |
| ***H01Q 19/10*** | (2006.01) |

(52) U.S. Cl.

CPC ..... *H01Q 9/26* (2013.01); *H01Q 1/02* (2013.01); *H01Q 1/2291* (2013.01); *H01Q 1/246* (2013.01); *H01Q 15/14* (2013.01); *H01Q 19/108* (2013.01)

(58) Field of Classification Search

CPC ..... H01Q 15/14; H01Q 9/26; H01Q 19/10; H01Q 19/108; H01Q 1/02; H01Q 1/22; H01Q 1/2291; H01Q 1/246

USPC ..... 343/700 MS, 795, 797, 799, 803, 817, 343/833, 834

See application file for complete search history.

(56) References Cited

U.S. PATENT DOCUMENTS

| | | | | |
|---|---|---|---|---|
| 5,867,130 | A * | 2/1999 | Tay | H01Q 1/38 343/700 MS |
| 6,975,278 | B2 * | 12/2005 | Song | H01Q 9/26 343/795 |
| 7,292,198 | B2 * | 11/2007 | Shtrom | H01Q 1/38 343/700 MS |
| 9,093,758 | B2 * | 7/2015 | Kish | H01Q 3/242 |
| 9,246,235 | B2 * | 1/2016 | Smith | H01Q 19/30 |
| 2006/0092078 | A1 | 5/2006 | Sanford | |
| 2007/0152903 | A1 * | 7/2007 | Lin | H01Q 3/242 343/795 |
| 2012/0098730 | A1 | 4/2012 | Kish et al. | |

(Continued)

OTHER PUBLICATIONS

International Search Report and Written Opinion for Application No. PCT/US2016/024222 dated Jul. 11, 2016.

*Primary Examiner* — Tho G Phan

(74) *Attorney, Agent, or Firm* — Honigman Miller Schwartz and Cohn LLP

(57) ABSTRACT

An access point includes an access point body and a circuit board supported by the access point body and optionally configured to provide a residential gateway to a network. The circuit board includes a plurality of multi-dipole antennas connected to the circuit board and arranged around a longitudinal axis defined by the circuit board. The access point also includes a reflector disposed on the circuit board and a directional antenna connected to the circuit board and arranged adjacent to the reflector.

9 Claims, 11 Drawing Sheets

(56) References Cited

U.S. PATENT DOCUMENTS

| | | | |
|---|---|---|---|
| 2013/0222201 | A1 | 8/2013 | Ma et al. |
| 2014/0145890 | A1 | 5/2014 | Ramberg et al. |
| 2014/0257591 | A1 | 9/2014 | Cheng et al. |
| 2014/0318127 | A1 | 10/2014 | Kerns et al. |
| 2014/0318128 | A1 | 10/2014 | Kerns et al. |

* cited by examiner

WIRELESS ACCESS POINT

TECHNICAL FIELD

This disclosure relates to wireless access points.

BACKGROUND

Generally, a home network includes a single WiFi enabled access point (AP) built into a home network gateway (also called a residential gateway), which is usually located in a living room or a home office of the home, WiFi performance typically varies with distance between WiFi enabled mobile devices and the access-point and may be adversely affected by certain obstacles inside the home. As a result, a home network using a single access point can become challenging in 2- or 3-story single family houses or residences constructed of reinforced concrete or metal.

SUMMARY

The Internet may provide next generation high-speed data and digital media services, such as voice, video, gaming, etc. Broadband networks using fiber optic technologies to an end-user residence may remove a bandwidth bottleneck between network operators and an end-user by offering Gigabit per second and beyond access speeds. To make efficient use of the access bandwidths available through fiber optic access technologies, efficient in-house connectivity may be necessary to connect various digital players and home networking devices within the end-user residence.

The present disclosure provides a wireless access point having one or more antennas arranged to provide directional and/or omnidirectional reception with a circuit board configured to provide a residential gateway to a network. Multiple access points within a home may be used to improve signal coverage in a relatively large home or a home having rooms separated by concrete or metal walls. In many newly constructed homes, structured wiring of Category 5 or 6 twisted copper pairs are available to support 1 Gb/s data connectivity from a wiring closet. High-definition contents, such as 4k-resolution and 3-D videos may require relatively high bandwidth connectivity from a residential gateway to a set top box, which may not be available with existing wireless connections offered by a single access point. Moreover, it is difficult to guarantee a quality of service (QoS) with wireless connections offered by WiFi connectivity. In some implementations, the set top box includes network bridging, allowing the set top box to act as a network extender for in-home networking. The network extender may extend the coverage of WiFi connectivity through Layer 2 bridging using coaxial cable or structured Ethernet connections. Moreover, the set top box may extend the Ethernet connectivity through coaxial bridging.

One aspect of the disclosure provides an access point including an access point body and a circuit board supported by the access point body. In some examples, the circuit board is configured to provide a residential gateway to a network. The circuit board includes a plurality of multi-dipole antennas connected to the circuit board and arranged around a longitudinal axis defined by the circuit board. The access point also includes a reflector disposed on the circuit board and a directional antenna connected to the circuit board and arranged adjacent to the reflector.

Implementations of the disclosure may include one or more of the following optional features. In some implementations, each multi-dipole antenna includes a first dipole antenna and a second dipole antenna orthogonally polarized from the first dipole antenna. The circuit board may include a switch configured to select between the first dipole antenna and the second dipole antenna for wireless communications through the respective multi-dipole antenna. In some implementations, the first dipole antenna. further includes at least two first dipole antenna conductors oriented along a first dipole antenna phase axis defined by the first dipole antenna and a first feed line connector disposed on each first dipole antenna conductor. The second dipole antenna may include at least two second dipole antenna conductors orientated along a second dipole antenna phase axis. The second dipole antenna phase axis is oriented orthogonal to the first dipole antenna phase axis and a second feed line connector is disposed on each second dipole antenna conductor. In some implementations, each multi-dipole antenna is positioned to have the first and second dipole antenna phase axes arranged at an angle of about 45 degrees with respect to the longitudinal axis.

In some implementations, the directional antenna is arranged opposite the reflector. The reflector shapes a radiation pattern of the antenna to increase the gain of the directional antenna. The directional antenna may be a folded dipole antenna.

In some implementations, the circuit board is supported by the access point body to have a vertical orientation of the longitudinal axis with respect to a supporting surface. The reflector extends along a majority of the circuit board and is arranged to reflect communication signals to/from the directional antenna substantially along a communication axis at an angle with respect to the longitudinal axis and the plurality of multi-dipole antennas arranged substantially equiangularly around the longitudinal axis of the circuit board collectively forming an omnidirectional antenna. At least one of the antennas may be configured to transmit using Bluetooth standard, Bluetooth low energy standard, and/or IEEE 802.15.4 standard. In some example, the access point includes a spectral analysis antenna connected to the circuit board.

Another aspect of the disclosure provides an access point including an access point body and a circuit board supported by the access point body and optionally configured to provide a residential gateway. The access point further includes an antenna connected to the circuit board and a heat sink reflector disposed on the circuit board. The heat sink reflector includes a heat sink, configured to conduct heat from the circuit board and dissipate the heat convectively to air, and a reflector disposed on the heat sink and configured to reflect communication signals to/from the antenna.

This aspect may include one or more of the following optional features. In some implementations, the heat sink includes a fin base disposed on the circuit board. The fin base defines an elongated shape and a base longitudinal axis. The heat sink also includes fins extending from the fin base substantially perpendicular to the base longitudinal axis. Each fin has a proximal end disposed on the base and a distal end away from the base. The reflector is disposed on the distal end of at least one fin. In some implementations, the fins extend from the fin base along a common axis. The reflector may include a reflector base disposed on at least one of the fins and first and second signal reflectors extending from the reflector base away from each other. In some examples, the reflector base, the first signal reflector, and the second signal reflector each have a substantially flat surface and the substantially fiat surfaces of the first and second signal reflectors are at an angle with respect to the substantially flat surface of the reflector base. The reflector may define a reflector longitudinal axis and an extrudable cross-sectional shape along the reflector longitudinal axis. The extrudable cross-sectional shape may be :substantially U-Shaped, substantially V-Shaped, or substantially C-Shaped. Other cross-sectional shapes are possible as well. In some implementations, the heat sink reflector, as a whole, defines a longitudinal axis with an extrudable cross-sectional shape along the longitudinal axis.

Another aspect of the disclosure provides a heat sink reflector including a fin base having a first and second opposite surfaces, and defining a longitudinal axis. The heat sink reflector includes fins extending from the first surface of the fin base substantially perpendicular to the longitudinal axis. Each fin has a proximal end attached to the fin base and a distal end away from the fin base. The heat sink reflector also includes a reflector disposed on the distal end of at least one fin The reflector defines a non-linear cross-sectional profile along the longitudinal axis.

This aspect may include one or more of the following optional features. In some implementations, the fins extend from the tin base along a common axis. The reflector may be unattached and spaced from at least one fin. For example, the reflector may be attached to one or more fins and unattached to the remaining fins. In some implementations, the reflector includes a reflector base disposed on the at least one fin and first and second signal reflectors extending from the reflector base away from each other. The reflector base, the first signal reflector, and the second signal reflector may each have a substantially flat surface, and the substantially flat surfaces of the first and second signal reflectors are each at an angle with respect to the substantially flat surface of the reflector base. In some examples, the reflector defines a reflector longitudinal axis and an extrudable cross-sectional shape along the reflector longitudinal axis. The extrudable cross-sectional shape may be substantially U-Shaped, substantially V-Shaped, or substantially C-Shaped. Other cross-sectional shapes are possible as well. In some implementations, the fin base, the fins, and the reflector collectively define an extrudable cross-sectional shape along the longitudinal axis. Moreover, the reflector may be configured to reflect electromagnetic energy along a transmission axis defined at an angle with respect to the longitudinal axis of the fin base.

Yet another aspect provides a multi-dipole antenna that includes first and second dipole antennas. The first dipole antenna includes at least two first dipole antenna conductors oriented along a first dipole antenna phase axis defined by the first dipole antenna and a first feed line connector disposed on each first dipole antenna conductor. The second dipole antenna is orthogonally polarized from the first dipole antenna and includes at least two second dipole antenna conductors orientated along a second dipole antenna phase axis oriented orthogonal to the first dipole antenna phase axis and a second feed line connector disposed on each second dipole antenna conductor. In some implementations, each multi-dipole antenna is positioned to have the first and second dipole antenna phase axes arranged at an angle of about 45 degrees with respect to a common longitudinal axis. The multi-dipole antenna system may include a switch configured to select between the first dipole antenna and the second dipole antenna.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

New access technologies, such as fiber to the home (FTTH), are removing the bandwidth bottleneck between Internet service providers and end-user homes by providing sustainable and symmetric 1 Gb/s connectivity to end users. Such fiber access technology could potentially increase an access bandwidth to 10 Gb/s or above between service providers and end users.

Figure 1A:
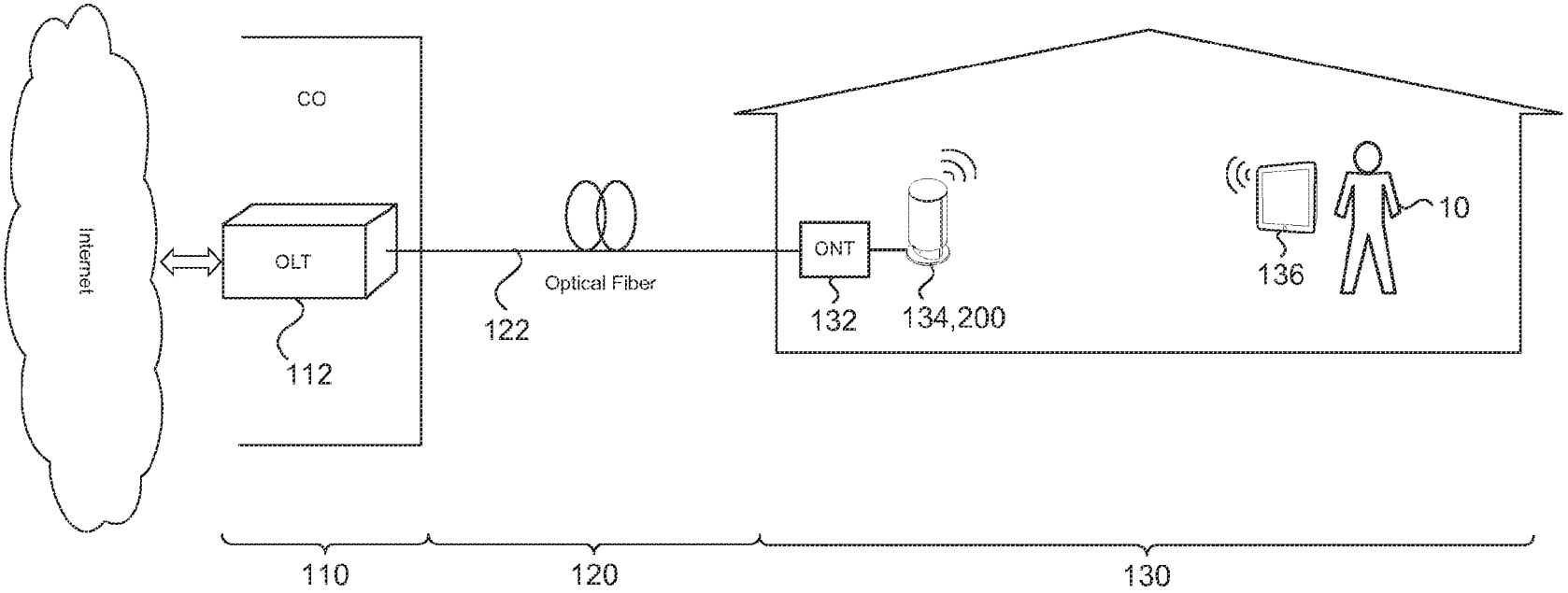
FIGS. 1A and 1B provide schematic views of exemplary architectures of a fiber-to-the-home (FTTH) network.
Figure 1B:
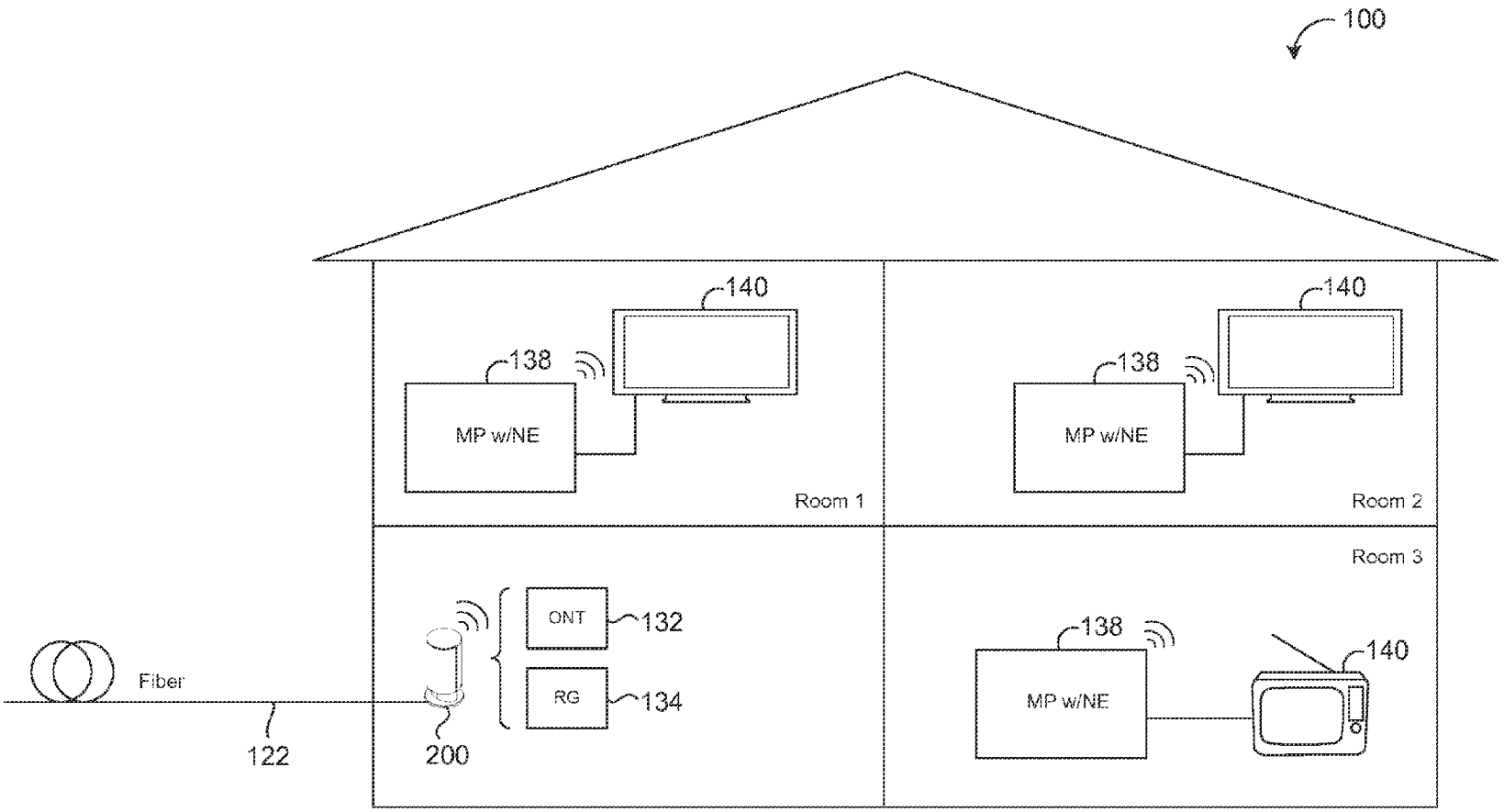

FIGS. 1A and 1B provide schematic views of exemplary architectures of a fiber-to-the-home (FTTH) network 100 establishing fiber-optic communications between an Internet service provider 110 and a residential network 130 of an end-user 10. An optical line termination (OLT) 112 of the Internet service provider 110 may provide a service provider endpoint for an optical network 120 that includes optical fiber 122 connecting the Internet service provider 110 to the end-user residential network 130 at an optical network terminal (ONT) 132. The optical line termination 112. converts electrical signals used by service provider equipment to/from fiber-optic signals used by the passive optical network 120. The optical line termination 112 also coordinates multiplexing between conversion devices (e.g., optical network terminals). The end-user residential network 130 may include an ONT 132.

The ONT 132 may convert an optical signal received from the Internet service provider 110 (over the optical network 120) into an electrical signal and provide Layer 2 media access control functions for the end-user residential network 130. The media access control (MAC) data communication protocol sub-layer, also known as the medium access control, is a sub-layer of the data link layer (Layer 2) specified in the seven-layer Open Systems Interconnection model (OSI model). Layer 1, the physical layer, defines electrical and physical specifications for devices. Layer 2, the data link layer, provides addressing and channel access control mechanisms, allowing several terminals or network nodes to communicate within a multiple access network incorporating a shared medium, e.g., Ethernet or coaxial cables.

A residential gateway (RG) 134 of the residential network 130 provides Layer 3 network termination functions. The residential gateway 134 may be equipped with multiple Internet protocol (IP) interfaces. In some implementations, the optical network terminal 132 and the residential gateway 134 are integrated as a single optical network-residential gateway device 134 (as shown in FIG. 1B). The residential gateway 134 acts as an access point for the residential network 130, for example, by offering WiFi connectivity to the residential network 130.

IP network devices 136 may be connected to the residential gateway 134 through a wired connection, such as a coaxial interface, an RI-45 interface, and/or a wireless interface, such as an RG-45 Ethernet interface for 802.11 WiFi. In the example shown in FIG. 1A, a portable electronic device interfaces wirelessly with the access point 200.

In the example shown in FIG. 1B, the FTTH network 100 includes an access point 200 that includes the ONT 132 and the residential gateway 134 as one unit. The access point 200 communicates wirelessly (and/or in a wired connection) with one or more set top boxes 138 (e.g., IPTV set top boxes), which may include a network extender that communicates with additional IP network devices 136, such as a computer, a cell phone, a tablet computer, etc. The set top box 138 may interface with a television 140, e.g., through a high definition multimedia interface (HDMI).

Figure 2A:
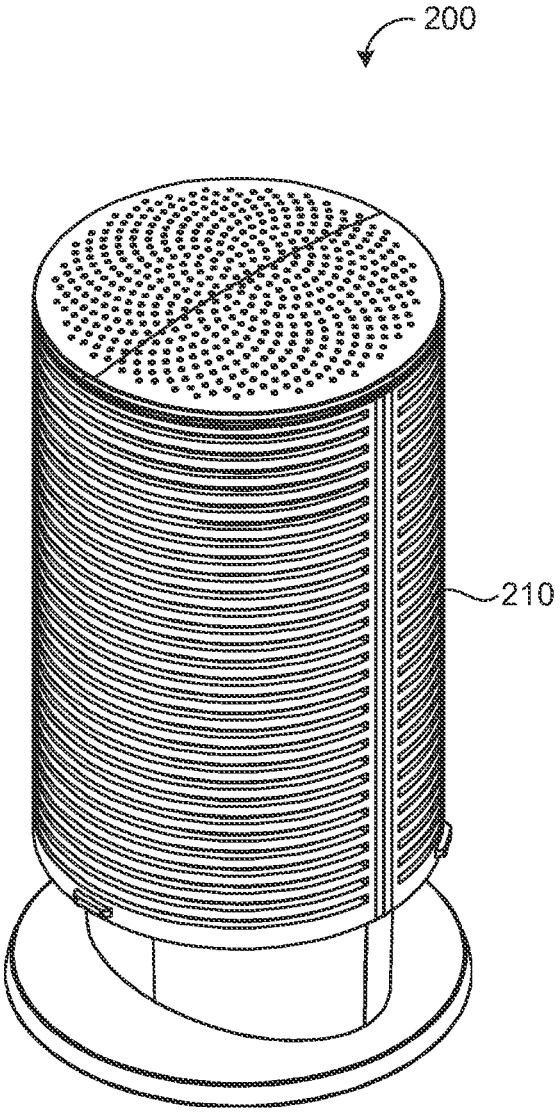
FIG. 2A is a perspective view of an exemplary wireless access point.

FIG. 2A provides a schematic view of an exemplary access point 200, which may connect to the Internet through a wired connection. The term wired connection or wired communication refers to the transmission of data over a wire-based or cable-based communication technology, such as, but not limited to, telephonic lines and/or networks, coaxial cables, television or internet access through a cable medium, fiber-optic cables, etc. Since current WiFi technologies cannot offer 1 Gb/s connectivity, a WiFi interface between the set top box 138 and the residential gateway 134 may cause a bandwidth bottleneck in the residential network 130. Moreover, WiFi throughput and performance depends on many factors, such as distance from an access point, Obstructions by walls, interference from other sources, etc. An access point 200 having a multitude of antenna types including a directional antenna offers increased antenna gain and higher data. transmission rates to provide improved WiFi throughput and performance.

Figure 2B:
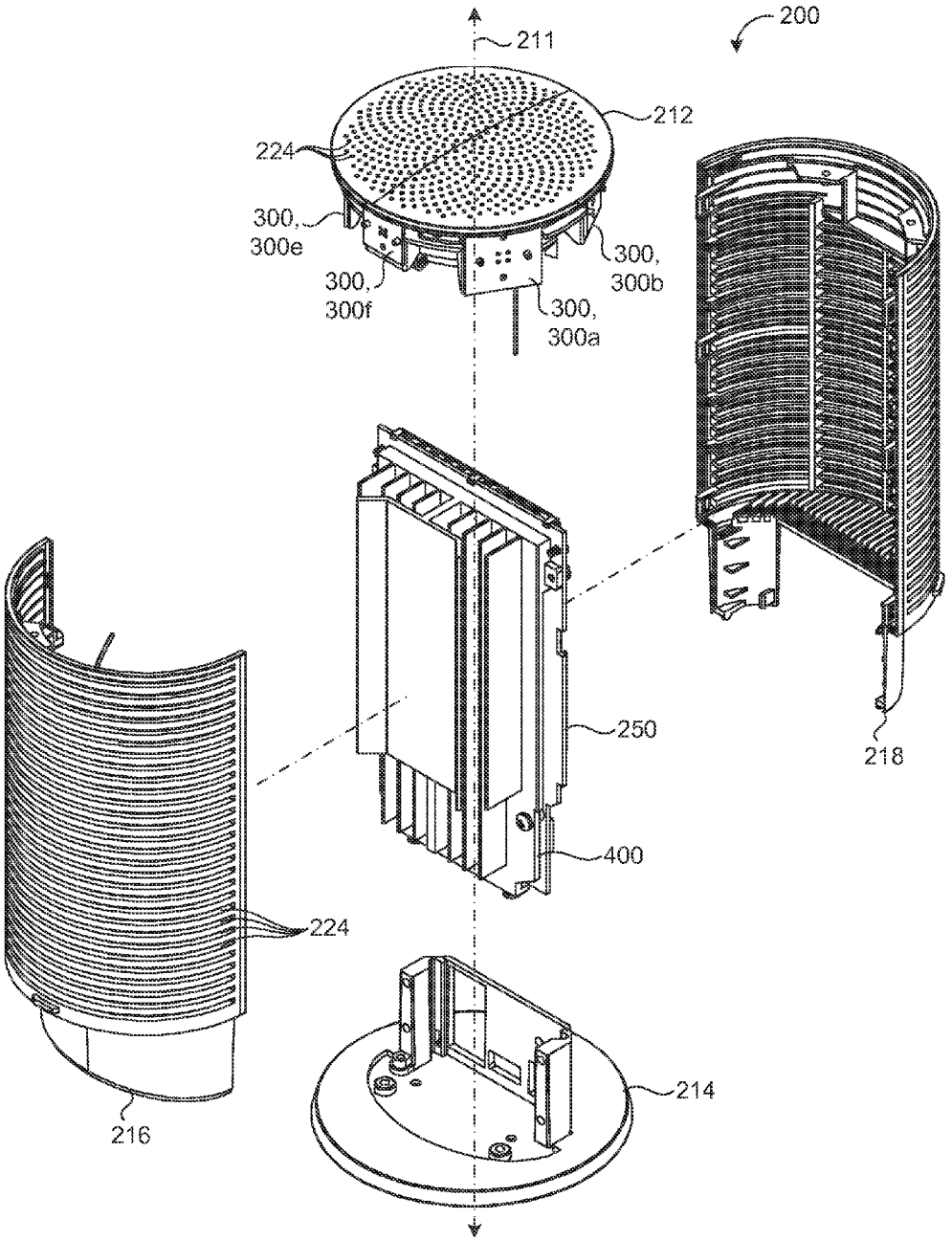
FIG. 2B is an exploded perspective view of the wireless access point shown in FIG. 2A.

FIG. 2B provides a partial exploded view of an exemplary access point 200 having an access point body 210 defining a longitudinal axis 211. The access point body 210 includes a top body portion 212 and a bottom body portion 214. A first mid-body portion 216 and a second mid-body portion 218 may connect the top body portion 212 and the bottom body portion 214 to form the access point body 210. The access point body 210 supports a circuit board 250 and a heat sink reflector 400. circuit board 250 and the heat sink reflector 400 may be connected together in a manner that allows the transfer of heat from the circuit board 250 to the heat sink reflector 400. The connection between the circuit board 250 and the heat sink reflector 400 may be achieved using a variety of fasteners, such as, but not limited to, screws, epoxy, press fit, thermal adhesives, thermal conductive tape, wire-form z clips, flat sprint clips, standoff spacers, push pins with ends that expand after installation, etc. The access point body 210 includes a plurality of access point vents 224 to allow airflow to pass through the access point body 210 and to the heat sink reflector 400. The airflow allows the heat sink reflector 400 to dissipate heat by convection to the surrounding air. Moreover, that the heat sink reflector may dissipate heat to any fluid, such as, coolant, water, air, nitrogen, various gasses, etc. In at least one example, the access point vents 224 are defined as holes (e.g., circular or rectangular apertures).

One of the challenges of designing a high throughput access point 200 is preventing individual antennas from creating interference with other antennas. The term interference refers to the effect of unwanted energy due to the emissions, radiation, or induction on an antenna in the system that results in degradation, obstruction or interruptions in communication. Some sources of interference include intermodulation between the transmitter and receiver, out of band emission and receiver desensitization.

Multiple antenna systems require good isolation and diversity between antennas to reduce interference and achieve a low correlation between a received wireless signal. One approach to prevent interference and reduce mutual coupling is to increase the separation between the individual antenna and another antenna to create spatial diversity in the system, resulting in an increased size of the system.

In some implementations, the circuit board 250 includes a wireless LAN controller, which serves to handle automatic adjustment to RE power, channels, authentication and security to create a WiFi interface between the set top box 138 and/or IP networked device 136 and the residential gateway 134 and may use the IEEE 802.11 standard for communication. The wireless connection may be created using traditional radio transmitter designs. A radio transmitter traditionally includes a carrier signal generation stage, one or more frequency multipliers, a modulator, a power amplifier, and a filter and matching network to connect to an antenna, which is used to transmit the WiFi signal to the set top box 138 and/or other IP networked device 136. The circuit board 250 may include a plurality of transmitters connected to a plurality of antennas 300, 300*a-f*, which may serve to increase the data transmission capacity by using multiple antennas 300 simultaneously. An additional use of having a plurality of antennas 300 is the ability to use antenna diversity. Antenna diversity is the use of two or more antennas 300 to improve the quality and reliability of a wireless link. In indoor or urban environments where there is no clear line of sight between the transmitter and receiver, the signal is reflected along multiple paths before being received creating phase shifts, time delays, attenuations and/or distortions, which can interfere with the receiving antenna. It is likely that if one antenna is experiencing interference from the signal being reflected along multiple paths, a second antenna may not be receiving the same interference allowing a more robust link to be created. Contained within the circuit board 250 is the switching and selection hardware to select the antenna 300, which is receiving the best signal. One method of selecting the antenna receiving the best signal may be the examination of received signal strength indicator (RSSI) of the various antennas 300 as defined in IEEE 802.11 standard.

Figure 2C:
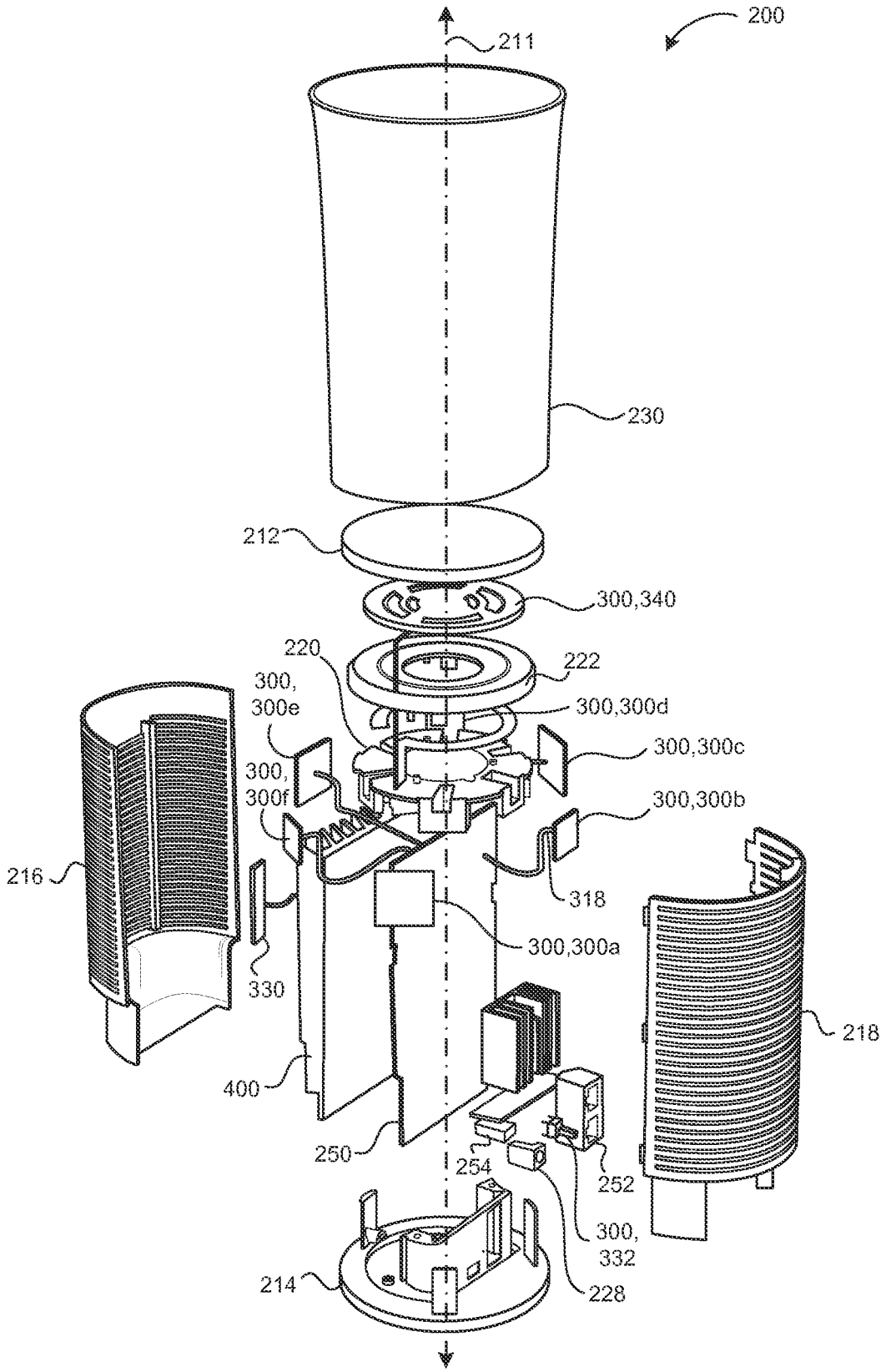
FIG. 2C is an exploded perspective view of an exemplary wireless access point.

FIG. 2C provides an exploded assembly view of the access point 200. The access point 200 may include an outer covering 230 that covers the access point body 210 to provide additional protection and may further facilitate improved airflow for cooling. Enclosed within the first mid-body portion 216 and second mid-body portion 218 is an antenna spacer 220. The antenna spacer 220 may be used to connect the first mid-body portion 216 and second mid-body portion 218. The circuit board 250 is located within the first mid-body portion 216 and second mid-body portion 218 and the circuit board 250 is connected to the heat sink reflector 400. Connected to the circuit board 250 may be an Ethernet connection 252 for wired communication and optical network connector 254 for connection to the Frill network 100. The plurality of antennas 300, 300*a* . . . 300*f* is connected to the circuit board 250.

In some implementations, the plurality of antennas 300, 300*a*, . . . 300*f* includes multi-dipole antennas 300*a* to 300*f* radially spaced from the longitudinal axis 211 and located equiangularly around the longitudinal axis 211, for example, in a transverse plane with respect to the longitudinal axis 211. One advantage of this configuration is that the plurality of antennas 300*a* . . . 300*f* creates an omnidirectional reception and transmission array without the disadvantages of a single omnidirectional antenna. By locating multiple antennas 300*a* . . . 300*f* with each phase axis 316, 326 (detailed below) at an angle of 45 degree to the longitudinal axis 211, a peak gain of each antenna 300*a* . . . 300*f* is in the null position of the other antennas 300*a* . . . 300E For example, if a first antenna 300*a* is transmitting with a phase 45 degree clockwise off vertical, a second antenna 300*b* positioned 45 degrees counter-clockwise is in the null transmission point, as the second antenna 300*b* is out of phase for phase transmissions from the first antenna 300*a*. This can provide an advantage by improving each of the antennas 300*a* . . . 300*f* isolation and interference from the other antennas 300*a* . . . 300*f* radiation pattern. In at least one example, at least one of the antenna 300, 300*a* . . . 300*f* is connected to a batun 318 and the balun 318 is connected to the circuit board 250. The antenna 300*a* . . . 300*f* in use may be selected using a switch 228 controlled by the circuit board 250.

In at least one example, a spectral analysis antenna 340 is connected to the circuit board 250. The spectral analysis antenna 340 may serve to measure the radio environment to allow the circuit board 250 to select the channel(s) with the lowest amount of radio energy or inference present, allowing for a better connection between the access point 200 and devices communicating with the access point 200. The spectral analysis antenna 340 may be located above the antenna spacer 220 by a spectral analysis antenna spacer 222. The spectral analysis antenna spacer 222 may serve to provide separation of the spectral analysis antenna 340 from the other antenna 300, 300*a* . . . 300*f* in the access point 200, or it may be made of a material to shield the spectral analysis antenna 340 from interference by the other antenna 300, 300*a* . . . 300*f* in the access point 200.

At least one antenna 300 may be a directional antenna 330. The directional antenna 330 may be located in front of the heat sink reflector 400 to improve the range and gain of the standard antenna 300 by converting it to a directional antenna 330. The directional antenna 330 may be a folded dipole antenna. A folded dipole antenna is an antenna where the two ends of the dipole antenna are connected. The directionality of the directional antenna 330 may be altered by placing the directional antenna 330 adjacent to the heat sink reflector 400. The specific amount of directionality may be altered by changing the spacing of the directional antenna 330 from the heat sink reflector 400, the width of the heat sink reflector 400 and/or curvature of the heat sink reflector 400. In at least one example, the placement of the directional antenna 330 and heat sink reflector 400 increase the gain of the antenna by 6 dB.

At least one of the antennas 300 may be a wireless antenna 332 capable of communicating using the Bluetooth standard, Bluetooth low energy standard and the IEEE 802.15.4 standard for low rate wireless personal area networks, The wireless antenna 332 may be mounted directly to the circuit board 250, and/or may be a chip antenna on the circuit board 250. Moreover, the wireless antenna 332 may be used for Internet of things type communication within the network. In at least one example, the circuit board 250 has at least 12 WiFi multi-dipole polarized antennas 300, 300*a* . . . 300*f*, at least one wireless antenna 332, and one spectral analysis antenna 340 connected to the circuit board 250.

A radio wave is comprised of an electric field and a magnetic field. These two fields occur at right angles to each other. In a traditional whip (rod) antenna, the electric field of the radio wave oscillates along the length of the antenna called the plane of oscillation. For example, a whip antenna that is placed vertically from the ground will have an electric field with a vertical plane of oscillation, and by contrast a whip antenna that is placed horizontally to the ground will have an electric field with a horizontal plane of oscillation. The greater the angle difference between the plane of oscillation of the transmitting antenna and the receiving antenna orientation the greater the loss in the antenna's ability to receive the radio wave. This can become practically problematic in indoor or urban environments where there is no clear line of sight between the transmitter and receiver. When there is no clear line of sight, the signal is reflected along multiple paths and the reflections can alter the plane of oscillation preventing proper reception by a receiving antenna. One solution to this problem is the use of multiple antennas with different orientations to more closely match the plane of oscillation of the signal after it has been reflected along one or more paths.

Figure 3:
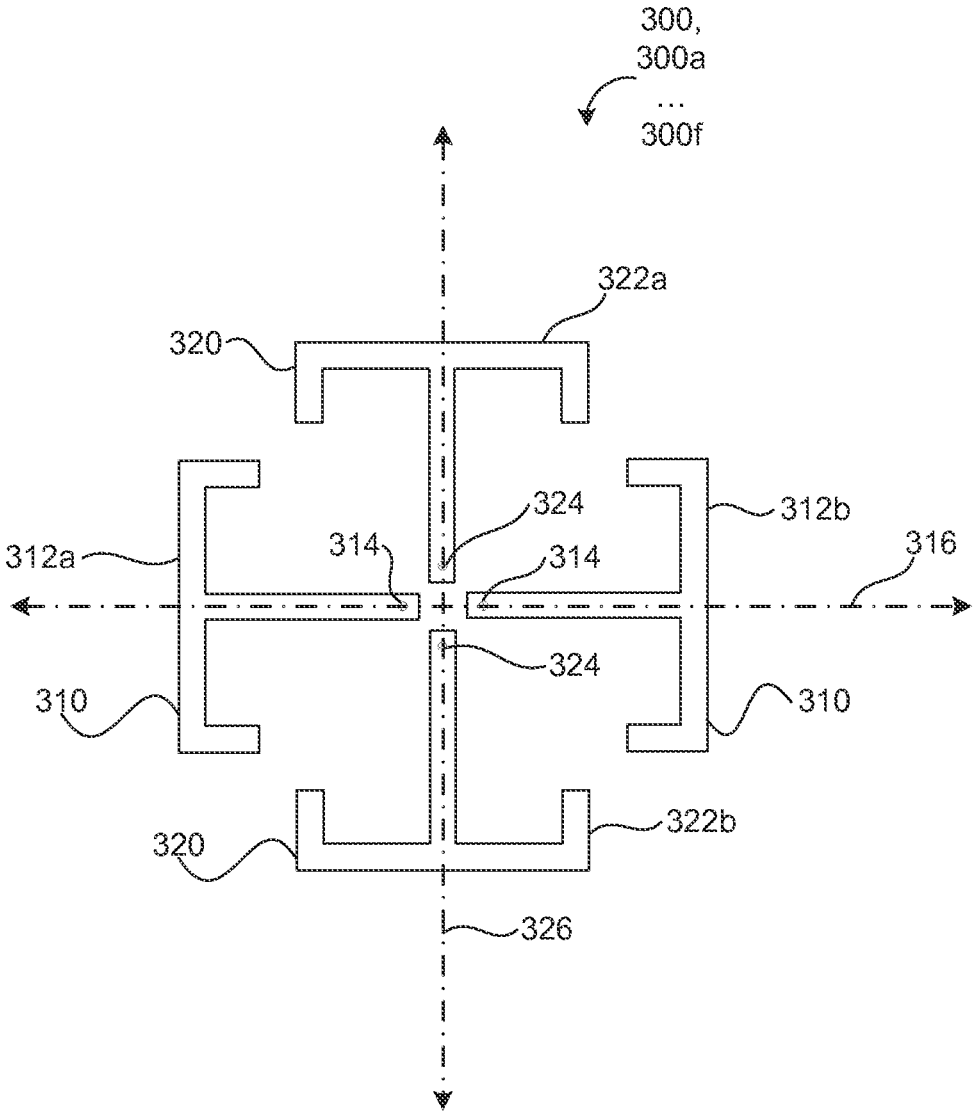
FIG. 3 is a top view of an exemplary antenna.

FIG. 3 provides a schematic view of an antenna 300 that includes a first dipole antenna 310 and a. second dipole antenna 320. The first dipole antenna 310 includes two first dipole antenna conductors 312*a*, 312*b*. The two first dipole antenna conductors 312*a*, 312*b* each contain a first feed line connector 314, which is used to connect one of the first dipole antenna conductors 312*a*, 312*b* to the transmitter contained on the circuit board 250. In at least one example, the first feed line connector 314 is connected to a balun 318. The balun 318 serves to convert a balanced signal, two signals working against each other where ground is irrelevant, to an unbalanced signal, a single signal working against a ground or pseudo ground. The two first dipole antenna conductors 312*a*, 312*b* form a first dipole antenna phase axis 316. The first dipole antenna phase axis 316 is representative of the transmission phase of the radio signal originating from the first dipole antenna 310.

Similarly, the second dipole antenna 320 includes two second dipole antenna. conductors 322*a*, 322*b*, The two second dipole antenna conductors 322*a*, 322*b* each contain a second feed line connector 324, which is used to connect one of the second dipole antenna conductors 322*a*, 322*b* to the transmitter contained on the circuit board. 250. The two second dipole antenna conductors 322*a*, 322*b* form a second dipole antenna phase axis 326. The second dipole antenna phase axis 326 is representative of the transmission phase of the radio signal originating from the second dipole antenna 320. The first dipole antenna phase axis 316 is located orthogonally to the second dipole antenna phase axis 326. By having the one dipole antenna orthogonal to another dipole antenna, improved polarization diversity is achieved, and by using switching diversity on the circuit board 250, the dipole antenna 310, 320 closest to the phase of the signal being received may be selected for improved reception.

In a system with multiple antennas 300, 300*a* . . . 300*f*, it may be advantageous to locate each phase axis 316, 326, 45 degrees from a common axis, such as the longitudinal axis 211 of the access point body 210 (which may be a common or parallel longitudinal axis with the circuit board 250). This provides an advantage of allowing the peak gain of one of the dipole antennas to be in the null position of the other multi-dipole antenna 300, 300*a* . . . 300*f* with respect to the radiation pattern. Moreover, locating multiple antennas 300 with each phase axis 316, 326 at a 90 degree or similar angle to each other, places each antenna 300, 300*a* . . . 300*f* in the null position of the other antennas 300, 300*a* . . . 300*f*.

Referring to FIGS. 4A-4D, in some implementations, the heat sink reflector 400 defines a longitudinal axis 402 and includes a heat sink 410 and a reflector 440 joined together. In some implementations, the heat sink 410 includes a fin base 420 having a first and second opposite surfaces 422, 424 extending along the longitudinal axis 402. The fin base 420 may define an elongated shape for contact with the circuit board 250 to absorb heat from the various components on the circuit board 250. A plurality of fins 430 extend from the fin base 420. Each fin has a proximal end 432 disposed on the fin base 420 and a distal end 434 away from the fin base 420. The heat absorbed by the fin base 420 is dissipated along the tins 430 to air or another cooling medium. The heat sink reflector 400 includes a reflector 440 connected to one or more of the fins 430. In the example shown, the reflector 440 is connected to the distal end 434 of one fin 430, but other a configurations are possible a well. For example, the reflector 440 may be connected to the distal ends 432 of several fins 430.

The reflector 440 may be placed adjacent to the directional antenna 300, 330. The combination of the reflector 440 and the directional antenna 300, 330 increases the gain of the directional antenna 300, 330, thereby increasing its range at the expense of the angle at which signals may be received by the directional antenna 300, 330. The reflector 440 modifies the radiation pattern of the antenna 300, 330 by reflecting electro-magnetic energy generally in the radio wavelength range. This advantageously allows a greater area of electro-magnetic energy to affect the directional antenna 300, 330, providing greater power and range. The reflector can have numerous shapes, such as, but not limited to, a non-linear cross-sectional profile, parabolic, flat, corner, cylindrical, angular, etc., and can reflect electro -magnetic energy to a plurality of antennas 300, 330. Moreover, the reflector 440 also acts as a fin 430 and serves to dissipate heat from the fin base 420.

In some implementations, the heat sink reflector 400 has a heat sink reflector first end 404 and a heat sink reflector second end 406 located at opposite ends along the longitudinal axis 402, where both ends 404, 406 have the same or similar profile. This provides an advantage in manufacturing, by allowing the heat sink reflector 400 to be created by the process of extruding the shape of the heat sink reflector first end 404 or heat sink reflector second end 406, reducing the cost and complexity of manufacturing. Accordingly, the heat sink reflector 400 may generally have an extrudable cross-sectional shape. In some implementations, the fin base 420 and the fins 430 are manufactured separately from the reflector 440 and connected together using for example, but not limited to, fasteners, epoxy, press fit, thermal adhesives, welding etc. In at least one example, the fins 430 extend along a common axis 408 (e.g., perpendicular to the longitudinal axis 402).

In some implementations, mounting tabs 426 are disposed on the fin base 420. These mounting tabs 426 may or may not be included in the profile for the extrusion. In some examples, where the mounting tab 426 is included in the profile for the extrusion, the mounting tab 426 is created by a secondary process such as, but not limited to, machining, stamping, water jet cutting, plasma cutting, etc. In some examples, where the mounting tab 426 is not included in the profile for the extrusion, the mounting tab 426 is created by attaching it to the fin base 420 by a secondary process such as, but not limited to, welding, fasteners, adhesive, epoxy, etc. In some implementations, the mounting tabs 426 or the fin base 420 defines one or more mounting holes 428 to provide a means for mechanically attaching the heat sink reflector 400 to the circuit board 250.

Figure 4A:
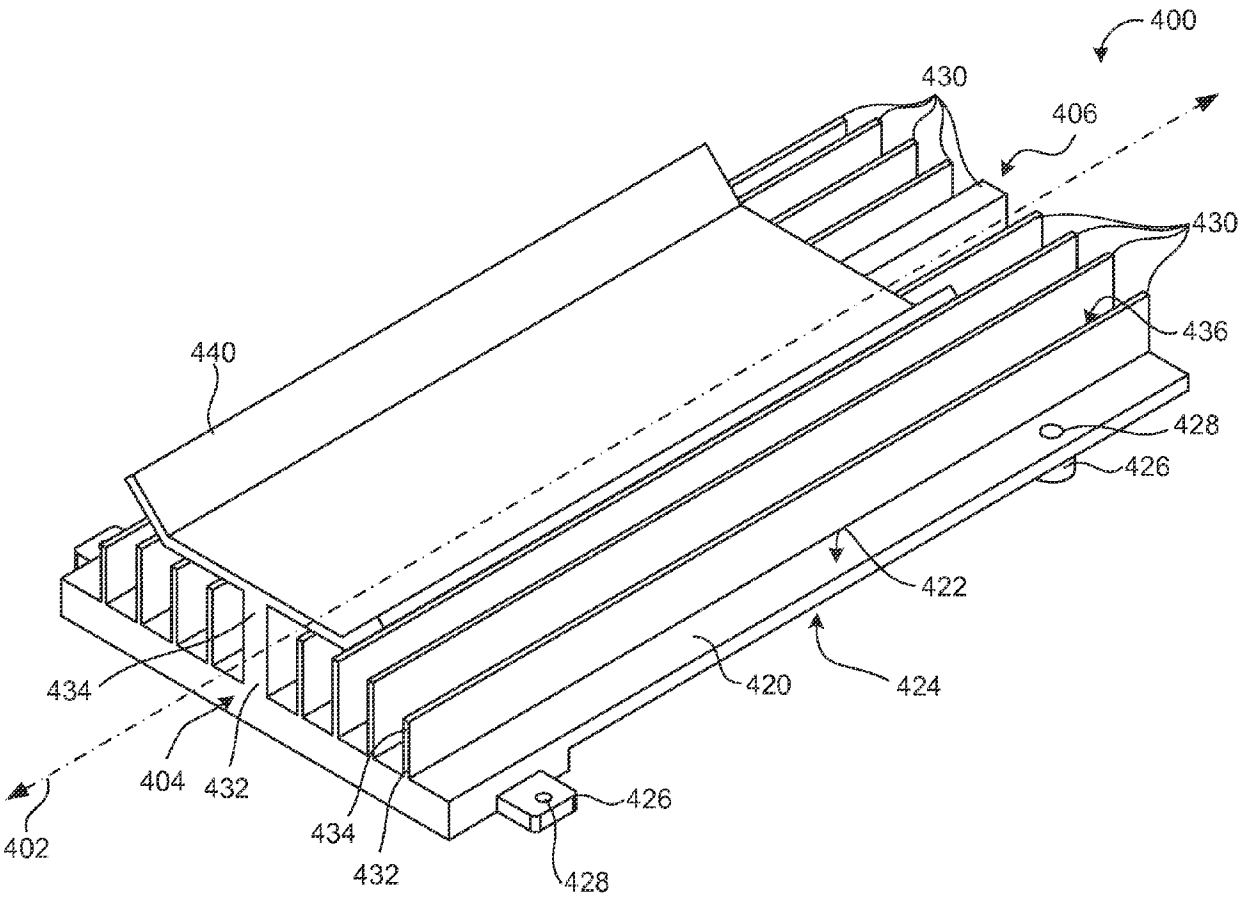
FIG. 4A is a perspective view of an exemplary heat sink reflector.
Figure 4B:
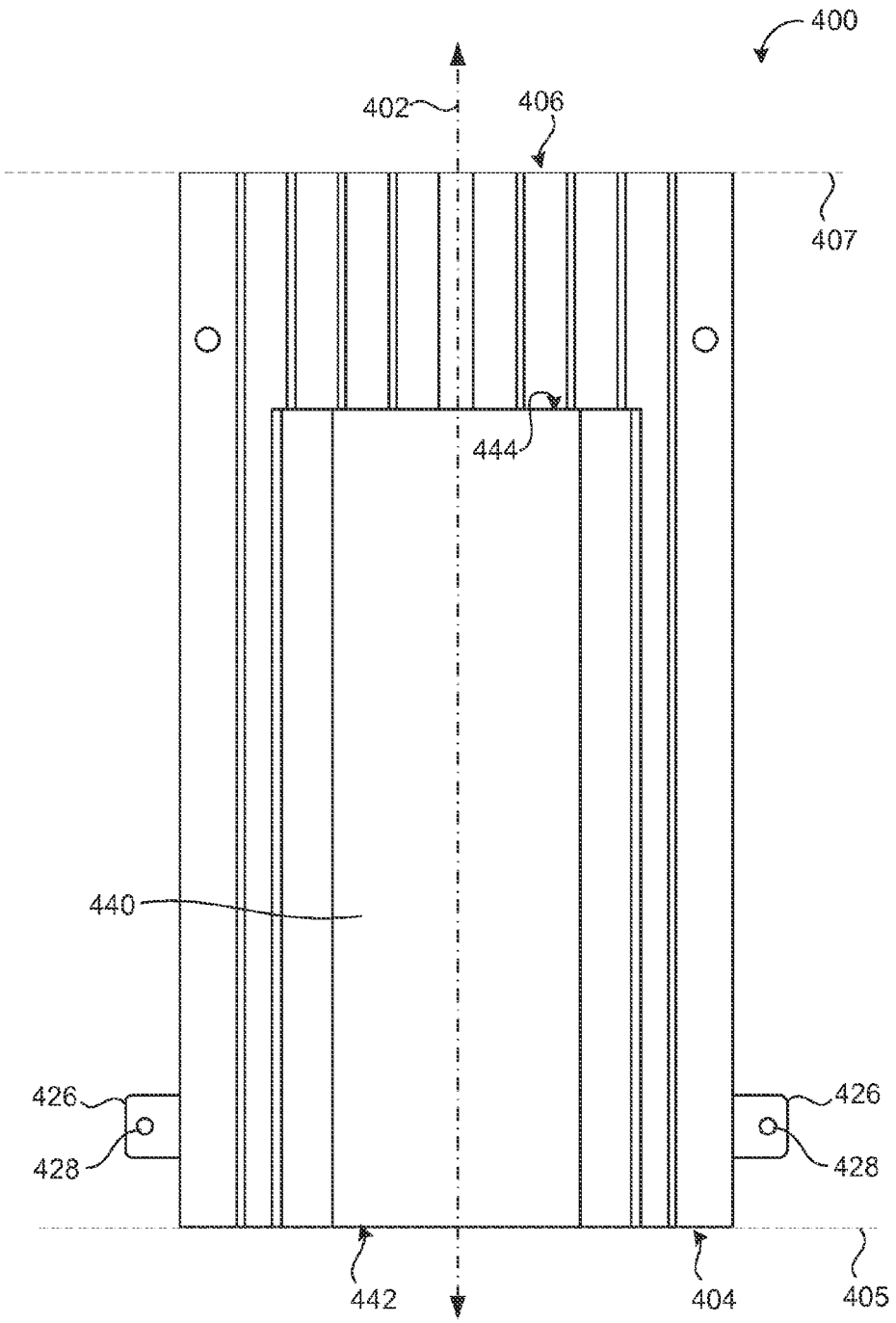
FIG. 4B is a front view of the heat sink reflector shown in FIG. 4A.
Figure 4C:
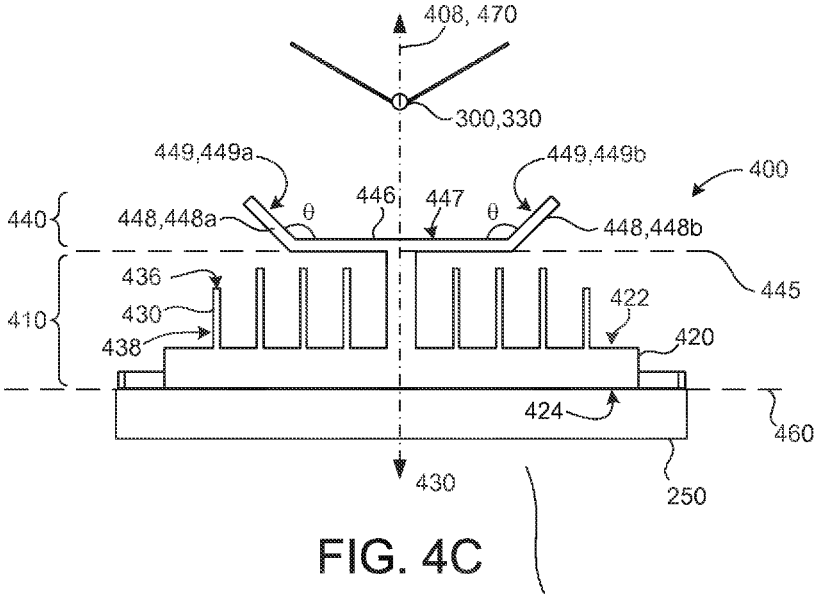
FIG. 4C is atop view of the heat sink reflector shown in FIG. 4A.
Figure 4D:
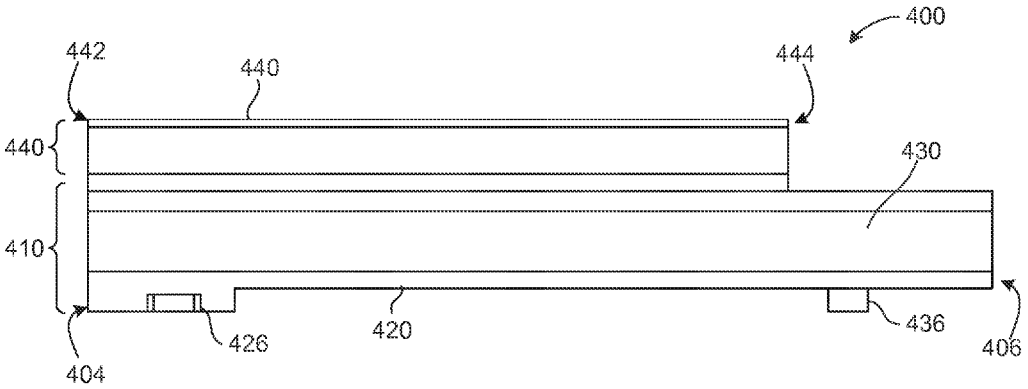
FIG. 4D is a side view of the heat sink reflector shown in FIG. 4A.

FIG. 4B provides atop view of the heat sink reflector 400. The heat sink reflector 400 has a first plane 405 along the first end 404 of the heat sink reflector 400 and a second plane 407 along the second end 406 of the heat sink reflector 400. The reflector 440 has a first end 442, which in this example is located at the first plane 405, and a second end 444, which is located between the first plane 405 and the second plane 407. The first end 442 of the reflector 440 and the second end 444 of the reflector 440 are opposite each other and located along the longitudinal axis 402 of the heat sink reflector 400. In at least one example, the first end 442 of the reflector 440 may also be located between the first plane 405 and the second plane 407. In some examples, having a greater amount of the fins 430 and the fin base 420 not covered by the reflector 440 may be advantageous to increase the cooling capacity of the heat sink reflector 400 at the loss of some increased gain of the directional antenna 330 caused by the reflector 440. In some examples, the first end 442 and/or the second end 444 of the reflector 440 are/is located outside the first plane 405 or the second plane 407 of the heat sink reflector 400, FIG. 4C provides a front view of a heat sink reflector 400, the circuit board 250, and the directional antenna 330. In at least one example, the reflector 440 includes a reflector base 446, which is disposed on at least one fin 430. The reflector base 446 may be connected to at least one signal reflector 448, 448*a*, 448*b* arranged to reflect signals to/from the directional antenna 330. In sonic examples, the reflector base 446 and the signal reflector 448, 448*a*, 448*b* each have a substantially flat surface 447, 449, 449*a*, 449*b* arranged an angle θ with respect to each other. When the heat sink reflector 400 includes multiple signal reflectors 448*a*, 448*b*, the angles θ between the substantially flat surface 447 of the reflector base 446 and the substantially flat surfaces 449*a*, 449*b* of the signal reflectors 448*a*, 448*b* may be the same or different. The reflector 440 may have a cross-sectional shape that is substantially U-Shaped, substantially V-Shaped, or substantially C-Shaped. Other shapes are possible as well. In some examples, at least one fin 430 may has a fin top surface 436 spaced from an unattached from the reflector base 446 may be located above at least one fin top surface 436. In the example shown, the reflector 440 is supported by only one fin 430, which allows air to flow more freely between all of the fins 430 and the reflector 440.

The point of contact between the heat sink reflector 400 and circuit board 250 may form a heat sink base longitudinal plane 460. One surface of the reflector base 446 may form a reflector base plane 445. In at least one example, the directional antenna 330 may be located outside of the area between the reflector base plane 445 and the heat sink base longitudinal plane 460.

Each fin 430 may have a side surface 438, which is perpendicular to the top surface 436 of the fin 430, the reflector base plane 445 and the heat sink base longitudinal plane 460. In at least one example, the heat sink reflector 400 includes a communication axis 470. The communication axis 470 may be at angle (e.g., perpendicular) with respect to the reflector base plane 445. An orientation of the communication axis 470 may vary depending on the location and relationship of the reflector 440 to the directional antenna 330. The electromagnetic energy impacting the reflector 440 from in front of the reflector 440 and the directional antenna 330 may be reflected back towards the directional antenna 330 along the communication axis 470. A width of the reflector base 446 and the signal reflector(s) 448 may be related to an angle at which a signal is reflected back to the directional antenna 330. The narrower the angle of reflection of signal along the communication axis 470, the greater the increase in gain of the directional antenna 330 by the use of the heat sink reflector 400.

Figure 5A:
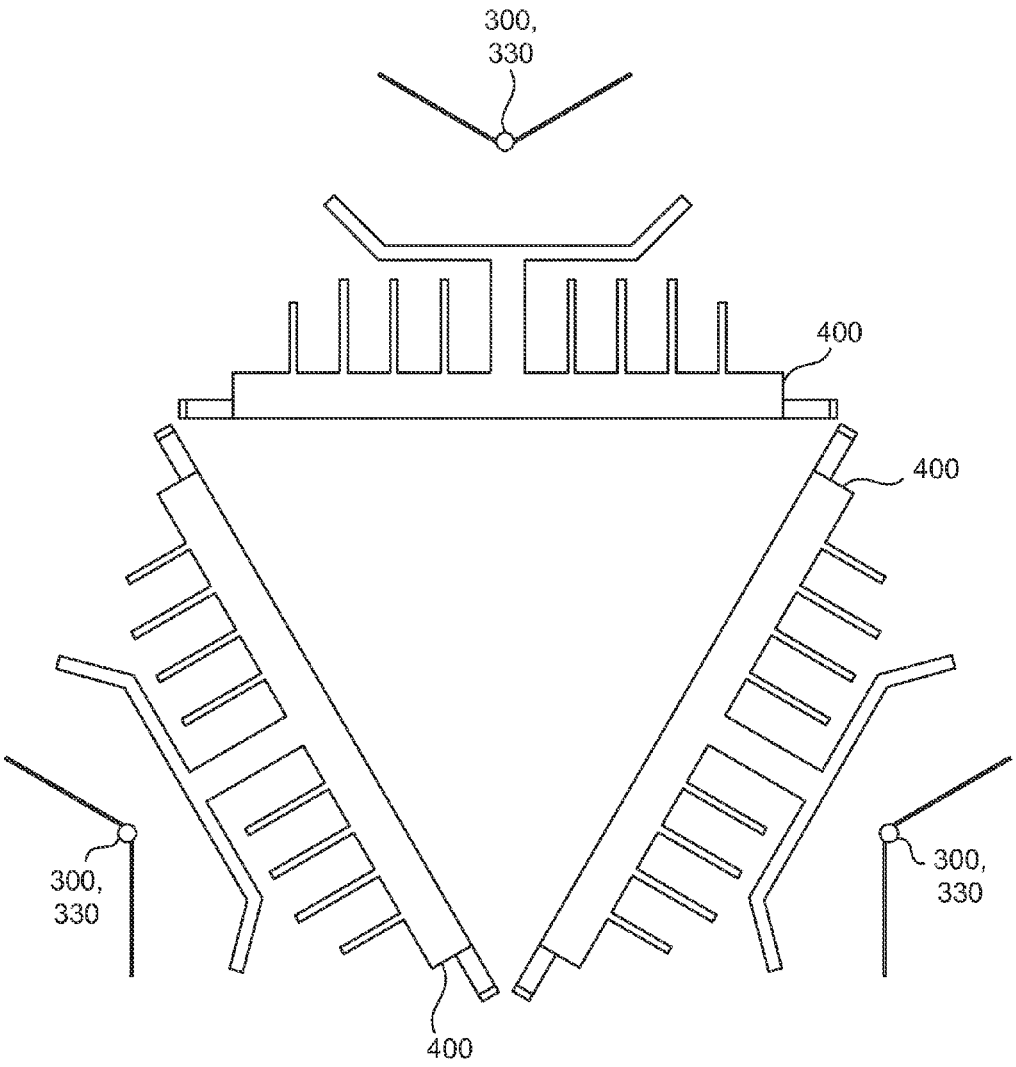
FIG. 5A is a top view of an exemplary heat sink reflector configuration.
Figure 5B:
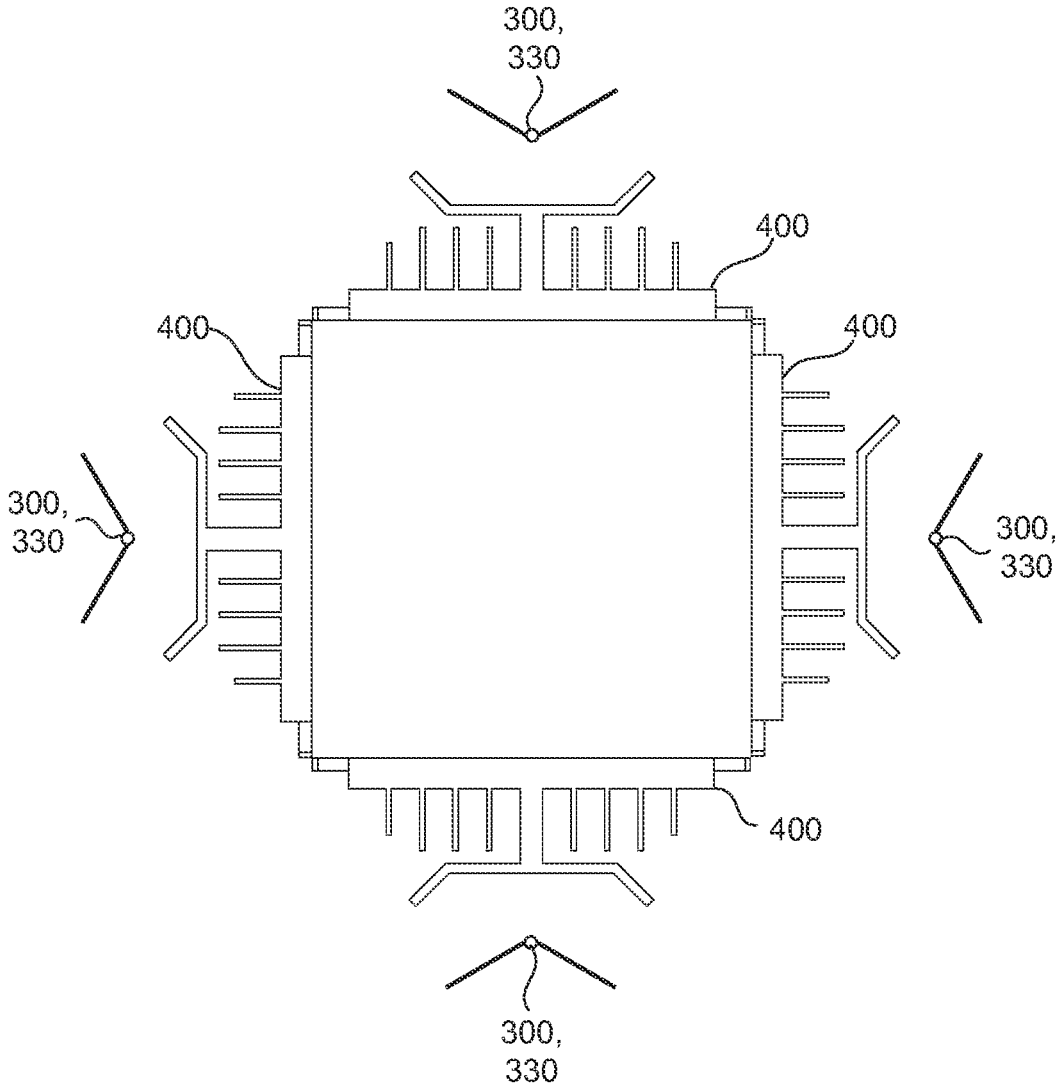
FIG. 5B is a top view of an exemplary heat sink reflector configuration.

The combination of the heat sink reflector 400 and the directional antenna 330 increases the gain of the directional antenna 330, but results in a reduction in lateral or side reception of the directional antenna 330. FIG. 5A provides a schematic view of three heat sink reflectors 400 and three directional antennas 330 arranged in a triangular pattern. FIG. 5B provides a schematic view of four heat sink reflectors 400 and four directional antennas 330 arranged in a square pattern. The advantage of this arrangement is that when one directional antenna 330 may not have adequate reception from signals located behind or to the side of the heat sink reflector 400, one of the other directional antennas 330 may likely have reception. Depending on the spacing of the directional antenna 330 and specific design of the heat sink reflector 400, the angle of reception may be different, requiring a different number of directional antennas 330 and heat sink reflectors 400 arranged in a polygon to ensure adequate reception and performance. The number of directional antennas 330 and heat sink reflectors 400 may be constrained by size and any polygonal shape may suffice to provide increased range and performance by this system.

A number of implementations have been described. Nevertheless, it will be understood that various modifications may be made without departing from the spirit and scope of the disclosure. Accordingly, other implementations are within the scope of the following claims.

What is claimed is:

1. An access point comprising:

an access point body;

a circuit board defining a longitudinal axis, the circuit board supported by the access point body to have a vertical orientation with respect to a supporting surface;

a plurality of multi-dipole antennas connected to the circuit board and radially spaced from the longitudinal axis, the plurality of multi-dipole antennas substantially equiangularly arranged around the longitudinal axis of the circuit board;

a reflector disposed on the circuit board and configured to reflect electromagnetic waves;

a directional antenna connected to the circuit board and arranged adjacent to the reflector;

a spectral analysis antenna connected to the circuit board and arranged vertically above the plurality of multi-dipole antennas, the spectral analysis antenna configured to measure radio energy and/or interference outside the access point body; and a spectral analysis antenna spacer disposed between the spectral analysis antenna and the plurality of multi-dipole antennas, the spectral analysis antenna spacer configured to shield the spectral analysis antenna from interference by the plurality of multi-dipole antennas.

2. The access point of claim 1, wherein each multi-dipole antenna comprises a first dipole antenna and a second dipole antenna orthogonally polarized from the first dipole antenna, the circuit board comprising a switch configured to select between the first dipole antenna and the second dipole antenna for wireless communications through the respective multi-dipole antenna.

3. The access point of claim 2, wherein the first dipole antenna further comprises:

at least two first dipole antenna conductors oriented along a first dipole antenna phase axis defined by the first dipole antenna; and a first feed line connector disposed on each first dipole antenna conductor.

4. The access point of claim 3, wherein the second dipole antenna further comprises:

at least two second dipole antenna conductors orientated along a second dipole antenna phase axis oriented orthogonal to the first dipole antenna phase axis; and a second feed line connector disposed on each second dipole antenna conductor.

5. The access point of claim 4, wherein each multi-dipole antenna is positioned to have the first and second dipole antenna phase axes arranged at an angle of about 45 degrees with respect to the longitudinal axis.

6. The access point of claim 1, wherein the directional antenna is arranged opposite and spaced from the reflector, the reflector shaping a radiation pattern of the antenna to increase a gain of the directional antenna.

7. The access point of claim 1, wherein the directional antenna is a folded dipole antenna.

8. The access point of claim 1, wherein the reflector extends along a majority of the circuit board and is arranged to reflect communication signals to/from the directional antenna substantially along a communication axis at an angle with respect to the longitudinal axis, the plurality of multi-dipole antennas substantially equiangularly arranged around the longitudinal axis of the circuit board collectively forming an omnidirectional antenna.

9. The access point of claim 1, wherein the at least one antenna is configured to transmit using Bluetooth standard, Bluetooth low energy standard, and/or IEEE 802.15.4 standard.

* * * * *